United States Patent [19]

Shedd

[11] Patent Number: 4,500,862

[45] Date of Patent: Feb. 19, 1985

[54] POWER SOURCE ISOLATOR

[76] Inventor: Harold E. Shedd, Rte. 1, Box 242, Nicholson, Ga. 30565

[21] Appl. No.: 467,947

[22] Filed: Feb. 18, 1983

[51] Int. Cl.[3] ..... H01H 39/00

[52] U.S. Cl. ..... 337/32; 337/31; 337/199; 361/104; 361/118

[58] Field of Search ..... 337/32, 199, 31, 33, 337/197, 198; 361/104–118

[56] References Cited

U.S. PATENT DOCUMENTS

| | | | |
|---|---|---|---|
| 662,466 | 11/1900 | Sachs | 337/32 |
| 1,813,582 | 7/1931 | Mason | 337/199 |
| 1,892,567 | 12/1932 | Craddock | 337/32 |
| 2,988,617 | 6/1961 | Graziosi | 337/199 |

*Primary Examiner*—Harold Broome

*Attorney, Agent, or Firm*—Newton, Hopkins & Ormsby

[57] ABSTRACT

A self-contained device to protect electrical appliances from damage or destruction caused by abnormal power surges due to lightening and other causes is plugged into any household electrical outlet and has a receptacle for the plug of the power cord leading to an appliance. The unitary device contains readily replaceable fuses directly in line with the appliance power line and the fuses are chosen to allow the appliance to receive the necessary power to operate while preventing it from receiving excessive damaging power. Extreme power surges due to lightening and the like are prevented from jumping the gap between the end terminals of blown fuses by following a grounding power stop clipped onto the fuse bodies near one pair of their end terminals and leading directly to a grounding conductor. The device is embodied in either a 110 v or 220 v configuration with two and three fuses respectively, and is also embodied in a television receiver protective arrangement.

9 Claims, 7 Drawing Figures

POWER SOURCE ISOLATOR

BACKGROUND OF THE INVENTION

Various forms of lightening arresters and power surge protective devices are known in the prior art. Such devices may for example protect a given circuit in a home or other building against surges caused by lightening or the like. However, these devices offer no protection whatsoever to electrical appliances which may be plugged in to the protective circuit, where the amperage on which the appliance operates is far below the amperage in the protected circuit to which the circuit protecting device responds.

U.S. Pat. No. 3,539,961 Worthington discloses an isolator for protecting an appliance from the destructive effect of excessive power. The Worthington device employs a fusible wire which disintegrates at a preselected amperage such as 10 amps. As a consequence, this device is only effective when used with one particular appliance which happens to operate on the same amperage with which the device is matched. An appliance operating on a significantly lower current value would not be protected by the device and could be damaged or destroyed before the fusible wire disintegrated. An appliance requiring a greater amperage than that which will cause the fusible wire to fail would not run at all because the fusible wire will consume itself at a preselected lower amperage.

Accordingly, the objective of this invention is to provide a greatly improved protective device or isolator for appliances of all types requiring differing ranges of amperages to operate. The device embodied in the invention is provided with readily replaceable fuses directly in the power line leading to the appliance, and these fuses match up with the amperage required to operate a particular appliance with safety at full protection against abnormal power surges. The fuses of the device are chosen to enable the appliance to receive the required current, and not too much or too little. By merely properly selecting the fuses to match up with the current drawing requirements of various appliances, any and all appliances can be protected. The device also possesses a necessary and critical escape route for excessive power surges due to lightening, etc. This escape route prevents the current surges from arcing or jumping the gap between the end terminals of blown fuses and thereby reaching the appliance. A grounding power stop element is clipped onto the glass bodies of the fuses relatively near corresponding terminals thereof so that any abnormal surge of power is routed directly to the grounding power stop and safely grounded and prevented from jumping the gap to the terminals at the remote ends of the fuses connected with the appliance.

While the prior art does contain teachings of fused protective devices as in U.S. Pat No. 1,892,567 Craddock, there is no provision in any known prior art device to prevent current surges from jumping the gap between terminals of blown fuses and thereby reaching an appliance.

Therefore, in essence, the present invention possesses two main advantages and capabilities not possessed by any prior art device. First, the device is completely effective to protect any and all appliances from damage caused by power surges through the use of readily interchangeable fuses chosen to meet the requirements of any appliance by delivering to that appliance only the amperage which it requires, and not too much or too little amperage. Second, by providing the unique grounding power stop which prevents excessive current surges from jumping the gap of blown fuses in the device, it become virtually impossible for an appliance to be damaged by lightening or the like.

DETAILED DESCRIPTION

Figure 1:
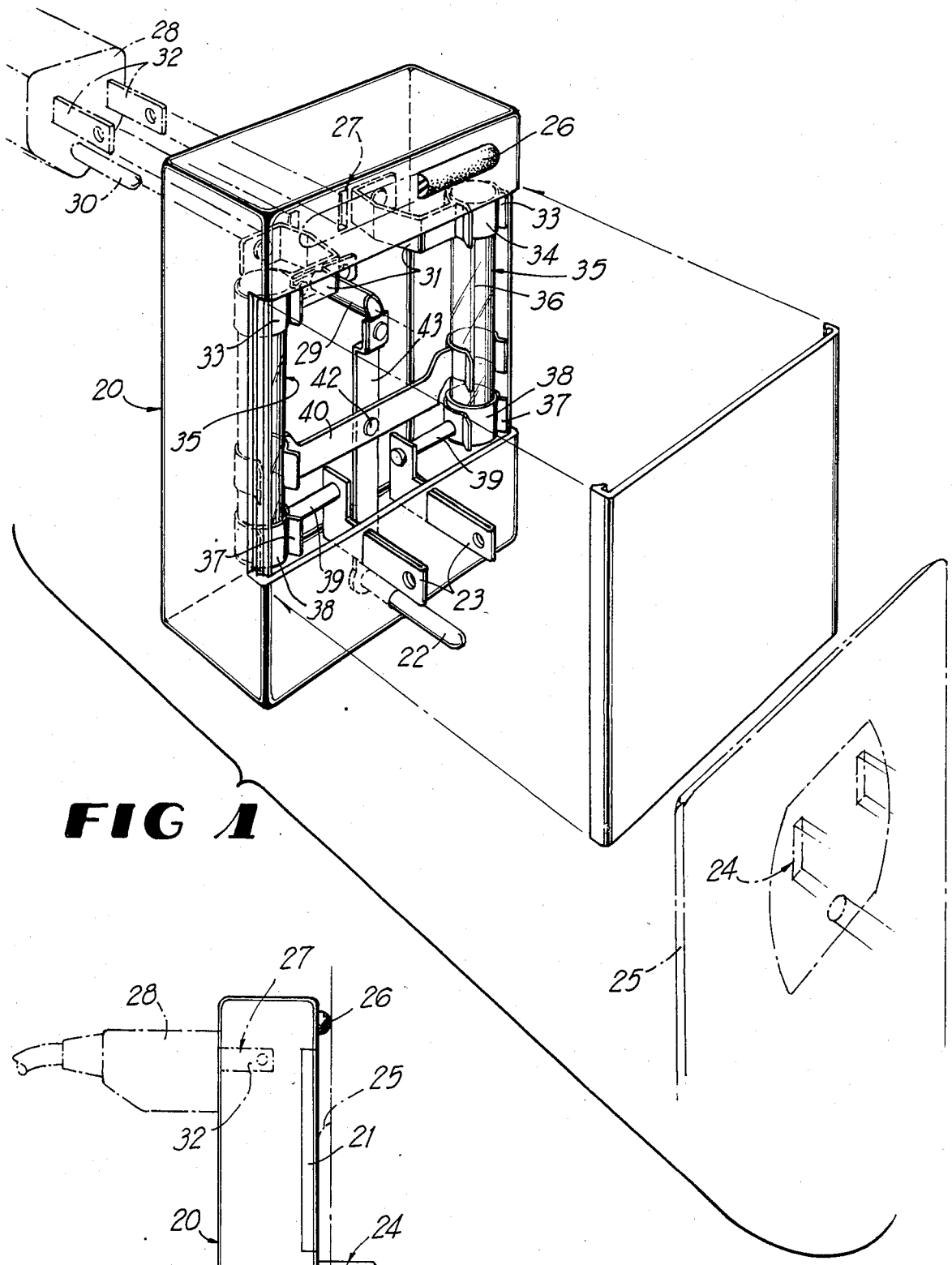
FIG. 1 is a partly exploded perspective view of a power surge isolator to protect appliances according to one embodiment of the invention.
Figure 2:
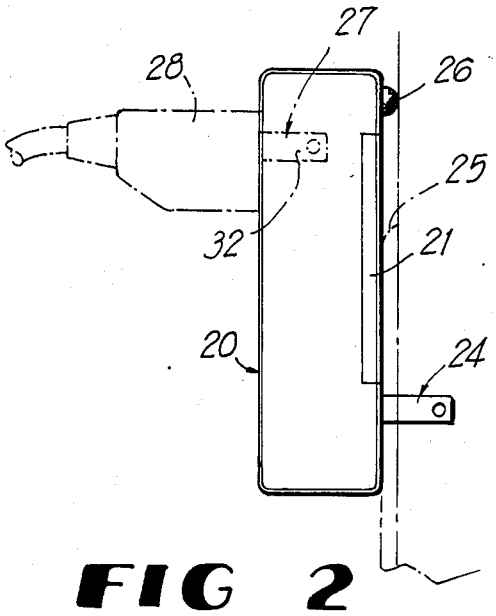
FIG. 2 is a side elevation of the device on a reduced scale.
Figure 3:
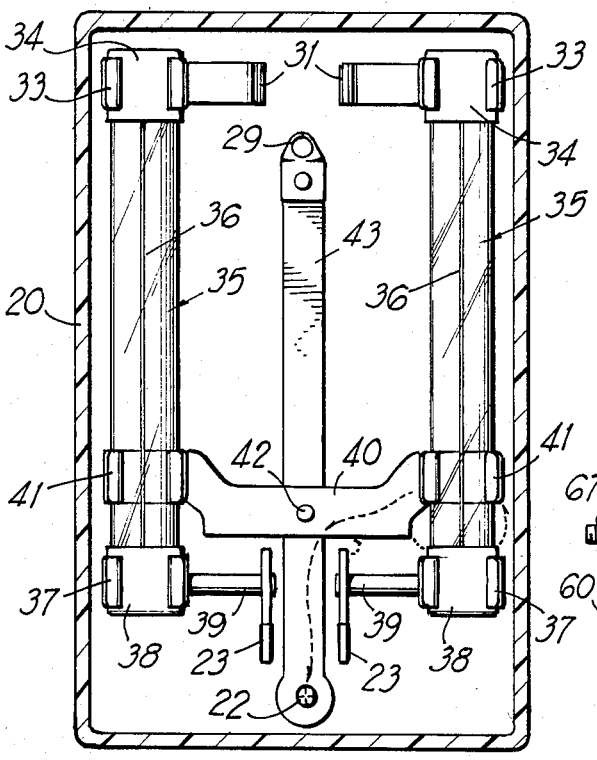
FIG. 3 is a front elevational view of the device with its housing shown in cross-section.

Referring to the drawings in detail, wherein like numerals designate like parts, and initially considering FIGS. 1 through 3, a power surge isolator for protecting electrical appliances comprises a rectangular casing 20 of insulating material having a removable access panel 21 on its forward side which can be snapped into engagement with the casing 20, as shown. The device near one of its ends is provided with three male prongs including a grounding prong 22 and two power prongs 23 in the customary triangular array for reception by a female wall receptacle 24 having a cover plate 25. The prongs 22 and 23 extend through the forward wall of the casing 20 and outside of the casing as shown. Near its other end the casing 20 carries a back stop rib 26 which engages the wall surface above or below the cover plate 25 to maintain the device parallel with the wall in a stable manner during use. When using with 110 v current, power enters one of the prongs 23 while the other prong 23 is a ground.

On its opposite side and near its end away from the male prongs 22 and 23, the device includes a female receptacle 27 for the three-pronged plug 28 of an appliance power cable. The female receptacle 27 of the device includes a conducting sleeve 29 for the grounding prong 30 of appliance plug 28 and two receptacle contact strips 31 to be engaged by the two prongs 32 of the plug 28.

Within the insulating casing 20 near its end receiving the appliance plug 28 a pair of fused terminal spring clips 33 are provided which are electrically connected and joined to the receptacle contact strips 31. The clips 33 embrace the adjacent end terminals 34 of a pair of fuses 35 whose fusible elements 36 will disintegrate when subjected to a certain current value. In this connection, the fuses 35 are selected to deliver the required operating current to any given appliance and to blow at current values above this required level. The chosen fuses will not deliver too much or too little current to the particular appliance with which they are selected to work. The ready interchange ability of the fuses 35 enables the selection of proper fuses to protect any type of appliance regardless of its operating current requirement and to supply the proper current thereto without blowing out, in accordance with one important feature of the invention. It can be mentioned that the two fuse configuration in FIGS. 1 through 3 represents the form of the device for use with 110 v appliances.

Near the other end of the unit adjacent to the male prongs 22 and 23 a second pair of spring clips 37 embrace the other end terminals 38 of the fuses 35 and are joined by conductor bars 39 with the male power prongs 23. Near and spaced somewhat from the clips 37 and fuse terminals 38, in accordance with a very important feature of this invention, a grounding power stop conducting element 40 in the form of a heavy conducting strip has its opposite ends joined to another pair of spring clips 41 which embrace the glass bodies of fuses 35. The clips 41 and power stop 40 are distantly spaced from the clips 33 and fuse terminals 34 for an important reason to be described.

The power stop 40 is electrically connected at its center by an element 42 with an internal ground conducting strip 43 of the device whose opposite ends are electrically connected with the grounding prongs 22 and the ground sleeve 29, respectively.

During operation with the prongs 22 and 23 plugged into a conventional wall outlet 24 and the appliance plug 28 plugged into the receptacle 27 of the device, normal operating current will be delivered through the device to the particular electrical appliance. The fuses 35, as previously explained, are chosen to deliver the required operating current to the particular appliance and to blow when subjected to currents or current surges significantly above the appliance operating current. Neither too much nor too little current will be delivered through the device to the particular 110 v appliance which it is supplying and isolating from abnormal current surges caused by lightening, etc.

Under normal conditions, on 110 voltage, current from the wall outlet 24 enters the device through one of the prongs 23 and flows through one of the elements 39 to one of the clips 37 and one of the fuse terminals 38. The normal current then flows through one of the elements 36 of the fuse to one of the terminals 34 and then through one of the clips 33 to one of the receptacle contacts 31 engaged with one of the prongs 32 of the appliance cord.

When an abnormal surge of current is encountered above normal operating current for the appliance, the fuse elements 36 will immediately disintegrate to protect the appliance. Additionally, it will not be possible regardless of the magnitude of the surge for the current to arc or jump the gap from fuse terminals 38 to terminals 34 which could destroy the appliance if allowed to occur. Instead, as indicated by the broken directional arrows in FIG. 3, the surging current can jump from the terminals 38 of the fuses to the nearby clips 41 of power stop 40, the surging current then passing through the power stop to the grounding conducting strip 43 of the device connected to the ground elements 22 and 29. By virtue of this arrangement, the abnormal current surge regardless of its magnitude passes safely to ground and the appliance remains isolated and protected from the current surge by the device. Although one of prongs 23 is a ground, on the 110 v circuit, it is also fused to keep a current surge from entering the appliance through that ground.

Figure 7:
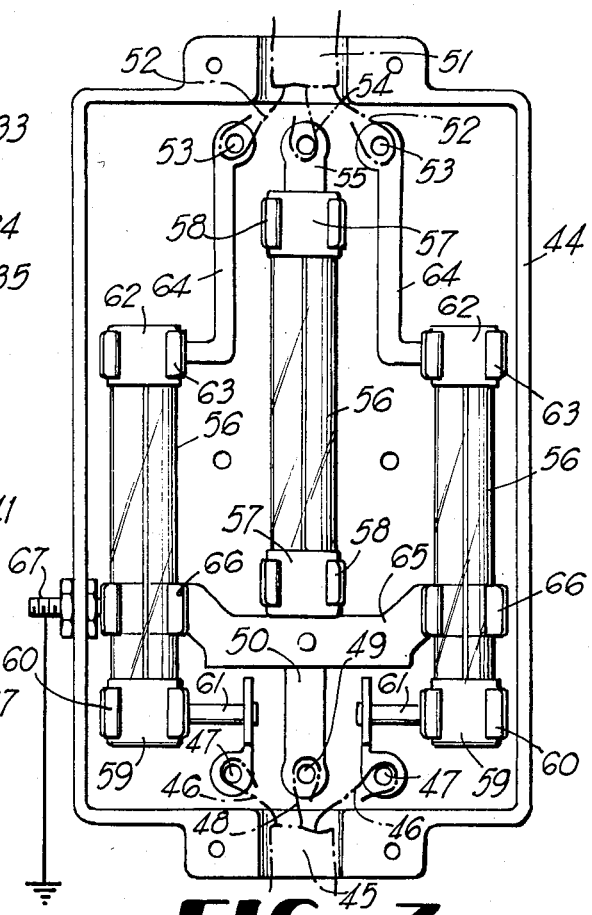
FIG. 7 is a view similar to FIG. 3 showing still another alternative embodiment to protect 220 v appliance circuits.

FIG. 7 of the drawings depicts an alternative embodiment of the device of the 220 v appliances such as electric ranges, washers and dryers and others. In this embodiment, the insulating casing 44 is a split casing formed in two half sections secured together by screws. A power cable 45 having a plug to engage in a wall outlet, or wired straight from a power source without plugs, has its two power conductors 46 connected with internal terminals 47 of the device and has its ground or neutral wire 48 similarly connected with a terminal 49 of a ground conductor strip 50 similar to the strip 43.

At the other end of the casing the cable 51 leading to the appliance has its two power conductors 52 connected to terminals 53 and has its neutral conductor 54 connected to a second terminal 55 of the ground strip 50.

Three fuses 56 are utilized in the 220 v embodiment. The end terminals 57 of the center fuse are engaged in spring clips 58 which are directly connected to the grounding strip 50 and form parts thereof. The two side fuses 56 have one pair of end terminals 59 engaged in spring clips 60 connected by conductor bars 61 to the terminals 47. Similarly, the opposite end terminals 62 of fuses 56 are held in spring clips 63 connected by conductor strips 64 to the power terminals 53. Again, the readily changeable 56 are selected to supply normal operating current to the particular appliance being isolated and protected by the device, and the fuses will blow when subjected to currents significantly above this normal level.

As in the previous embodiment, a safety power stop conductor strip 65 is connected at its center to the grounding strip 50 and includes spring clips 66 at its opposite ends which embrace the glass envelopes of fuses 56 relatively near the clips 60 and relatively distant from the clips 63. Provision is also made for an additional grounding connection 67 on one sidewall of the casing 44 and extending exteriorly thereof. The connection or terminal 67 is electrically connected with the adjacent power stop clip 66. The additional ground connection 67 gives added assurance of lightening passing to ground through an even easier path. The general mode of operation of the device in FIG. 7 is essentially the same as described for the prior embodiment employed with 110 v appliances. The device in FIG. 7 used with 220 v appliances differs from the prior embodiment by having the middle fuse 56 connected directly in the ground circuit. This completely isolates the appliance through the ground connection. The essential benefits of the device and its features have already been described.

Figure 4:
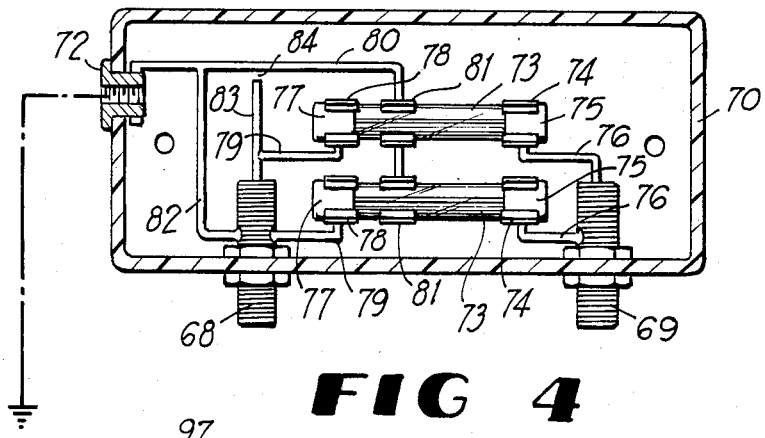
FIG. 4 is a similar view of an alternative embodiment of the invention for use with appliances that involve antennas.
Figure 5:
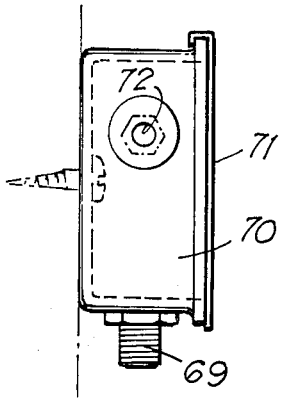
FIG. 5 is a side elevation of the device shown in FIG. 4.
Figure 6:
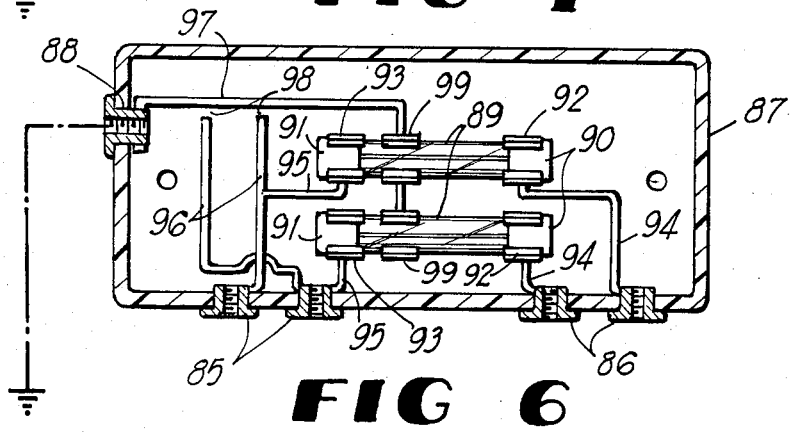
FIG. 6 is a view similar to FIG. 4 showing another alternative embodiment of the device.

FIGS. 4, 5 and 6 show further embodiments of the invention for use in protecting television receivers, CB radios, and like appliances employing antennas. FIGS. 4 and 5 show such a device having 75 ohm connections 68 and 69 for an antenna circuit. The protective device is enclosed in an insulating case 70 having a removable cover panel 71. One end wall of the case 70 mounts a ground wire connector 72.

Within the case 70 a pair of fuses 73 are held at one end in clips 74 which embrace fuse terminals 75 and are connected by conductors 76 with 75 ohm connection 69. The opposite end fuse terminals 77 are held in clips 78 connected by conductors 79 to 75 ohm antenna connection 68. One of the conductors 76 is electrically insulated from the outside rim, ground part, of the antenna connection 69 while the other conductor 76 is electrically connected to the outside rim, ground part, of the antenna connection 69. Similarly, one of the conductors 79, attached to the electrode 83, is electrically insulated from the outside rim, ground part, of antenna connection 68 while the other conductor 79 is electrically connected to the outside rim, ground part, of the antenna connection 68. The outside rim, ground part, of the antenna connection 68 is further electrically connected by conductor 82 to the ground power stop 80.

A grounding power stop 80 has one end electrically connected to the ground wire terminal 72 and has its other end connected with serially connected clips 81 which embrace the glass envelopes of fuses 73. The clips 81 are closely spaced from the clips 78, and more distantly spaced from clips 74. One of the connectors 79 for an antenna is further electrically connected by a conductor 82 with the grounding power stop 80. An electrode 83 or conductor end leading from connection 68, but insulated from its outside rim, is connected with the other conductor 79 and has a preset spark gap 84 with relation to grounding power stop 80. The electrode 83, although being part of the antenna terminal 68, is electrically insulated from the outside rim, ground part, of the antenna terminal 68. Similarly, one of the conductors 76 is insulated from the outside rim, ground part, of antenna terminal 69.

The device offers the same protection and isolation of the appliance such as a TV receiver from lightening and other abnormal current surges as do the previous embodiments. Current to the appliance power circuit is delivered through the connector 69. The fuses 73 allow normal operating current to enter the appliance and protect it by blowing out if an excessive surge of current is encountered. Such a current surge cannot jump the gap between the end terminals 77 and 75 of the blown fuses, and can only jump the gap to the nearby clips 81 of grounded power stop 80. Should lightening affect the antenna circuit through connection 68, the resulting surge of current can jump the gap 84 to the grounded power stop 80 as well as jumping the gaps between the clips 78 and 81, in all cases assuring complete isolating and protecting of the appliance.

FIG. 6 shows a final embodiment of the invention for antenna-equipped appliances having 300 ohm connections 85 and 86 for antenna circuit. Again, a case 87 of insulating material has a ground terminal 88 of one end wall for connection with a ground wire. Two fuses 89 have their end terminals 90 and 91 held in clips 92 and 93. The clips 92 are connected by conductors 94 with the connections 86 and the clips 93 are similarly connected by conductors 95 with the antenna connections 85. Conductor ends for electrodes 96 connected with the antenna elements 85 are spaces preset distances from a grounded power stop 97, thus providing spark gaps 98. The grounded power stop 97 is connected at one end to ground terminal 88 and at its other end to serially connected clips 99 which embrace the glass envelopes of fuses 89.

As in all of the other embodiments, the power stop clips 99 are spaced close to the clips 93 and more distantly from the clips 92 so that an abnormal surge of current cannot jump the gap from fuse terminals 92 to terminals 90, but can only jump the smaller distance to the power stop clips 99 and thereby be grounded through the power stop 97. The overall mode of operation of the device in FIG. 6 is essentially the same as previously described for the other embodiments and need not be repeated.

It is to be understood that the forms of the invention herewith shown and described are to be taken as preferred examples of the invention, and that various changes in the shape, size and arrangement of parts may be resorted to, without departing from the spirit of the invention or the scope of the subjoined claims.

I claim:

1. A power surge isolator and grounding device for the protection of electrical appliances comprising an insulating casing having male conducting prongs projecting from one side thereof for entry into a wall outlet and also having on its opposite side a female receptacle to receive the pronged plug of an appliance power cable, at least a pair of fuses in the casing through which normal operating current required by an appliance can be delivered and which fuses will blow when subjected to current significantly above said normal appliance current, said fuses having opposite end electrical terminals, conducting clips in the casing embracing corresponding end terminals of the fuses and being electrically connected with said male conducting prongs, additional conducting clips in the casing embracing the other end terminals of the fuses and being electrically connected with contact elements of the female receptacle, a grounding conductor element within the casing electrically connected to ground elements of the female receptacle and male conducting prongs, and a power stop conductor within the casing electrically connected to said grounding conductor and having clips embracing the glass envelopes of the fuses in relatively closely spaced relationship to corresponding end terminals of the fuses and relatively distantly spaced relationship to the opposite end terminals of the fuses.

2. A power surge isolator and grounding device as defined in claim 1, and conducting elements interconnecting the first named conducting clips with a pair of the male prongs which deliver power from a wall outlet, and additional conducting elements electrically connected between the other corresponding end terminals of the fuses and with contact elements of said female receptacle which deliver power.

3. An isolating and protecting device for electrical appliances adapted to be placed between an appliance power circuit and a power source comprising a casing, electrical terminal elements on the casing near its opposite ends adapted for connection with conductors of the appliance power circuit and with conductors of said power source, at least a pair of fuses within the casing having opposite end electrical terminals, conducting elements releaseably engaging the opposite end terminals of the fuses and being electrically connected with said electrical terminal elements on the casing near its oppostie ends, a grounding conductor element within the casing and being electrically connected with grounding parts of the electrical terminal elements on the casing near its ends, and a power stop conductor element within the casing electrically connected to said grounding conductor elements and having parts extending into relatively closly spaced relationship with corresponding end terminals of the fuses and relatively distantly spaced relationship to the opposite end terminals of the fuses.

4. An isolating and protecting device as defined in claim 3, and a third fuse in said casing having end electrical terminals and conducting means releaseably engaged with the end terminals of the third fuse and being electrically connected to the grounding conductor.

5. An isolating and protecting device as defined in claim 4, and said conducting means and conducting elements releaseably engaging the end terminals of the fuses comprising spring clip conductors.

6. An isolating and protecting device as defined in claim 3, and said conducting elements releaseably engaging the opposite end terminals of the fuses comprising spring clip conductors.

7. An isolating and protecting device for electrical appliances comprising an insulating casing, spaced electrical terminal elements on the casing adapted for connection with circuitry components of an appliance, at least a pair of fuses within the casing having opposite and electrical terminals, conducting elements releaseably engaging the opposite and fuse terminals and being electrically connected with said spaced electrical terminal elements on the casing, an electrical grounding element on the casing and being at least in part inside of the casing, a power stop conductor means within the casing electrically connected to said grounding element and having parts disposed in relatively closely spaced relationship to corresponding end terminals of the fuses and relatively distantly spaced relationship to the opposite end terminals of the fuses, and said spaced electrical terminal elements on the casing comprising antenna circuit terminal elements, one of the conductor elements electrically interconnecting the outside rim of the antenna terminal with the power stop conductor means within the casing, and an electrode element insulated from the outside rim of the antenna terminal within the casing connected with the antenna terminal and with the other conducting element releaseably engaging an adjacent fuse end terminal, and there being a spark gap formed between the end of the electrode and the power stop conductor means.

8. An isolating and protecting device as defined in claim 7, and said spaced electrical terminal elements on the casing comprising antenna circuit elements, and a pair of electrode elements within the casing electrically connected with the pair of antenna terminals and having tips spaced from the power stop conductor means and forming therewith a pair of spark gaps having preset distances, and both of said electrodes being electrically connected with both of the conducting elements releaseably engaging both end terminals of both of said fuses.

9. An isolating and protecting device for electrical appliances adapted to be intervened between an electrical wall outlet and the pronged plug of an appliance power cable, said device comprising an insulating casing, a female electrical receptacle built into one side of the casing near one end thereof to receive the pronged plug of an appliance power cable, male prong elements built into the opposite side of the casing near its other end and projecting exteriorly of the casing for engagement into a wall electrical outlet, a pair of replaceable identical fuses within the casing having end terminals, conducting clips holding the end terminals releaseably and being electrically connected with contacts of the built-in receptacle and built-in male prong elements, an electrical grounding element within the casing between the fuses and having end terminals electrically connected with ground elements of the built-in receptacle and built-in male prong elements, and a power stop conductor extending between said fuses near corresponding end terminals thereof and being releaseably engaged with the glass envelopes of the fuses and extending across said electrical grounding element and being directly electrically connected therewith.

* * * * *